United States Patent [19]

Böse

[11] 4,415,012

[45] Nov. 15, 1983

[54] RUCKSACK ASSEMBLY

[76] Inventor: Herbert Böse, Am Dachsbau 9, Bad Soden, Neuenhain, Fed. Rep. of Germany, D - 6239

[21] Appl. No.: 305,150

[22] Filed: Sep. 24, 1981

[30] Foreign Application Priority Data

Sep. 26, 1980 [DE] Fed. Rep. of Germany ..... 3036258

[51] Int. Cl.[3] ..... A45F 3/08; B65D 30/22; B65D 33/16

[52] U.S. Cl. ..... 150/51; 383/2; 383/32; 383/67

[58] Field of Search ..... 150/51; 190/42, 44, 190/52, 51; 224/153, 209–215

[56] References Cited

U.S. PATENT DOCUMENTS

| | | | |
|---|---|---|---|
| 3,957,184 | 5/1976 | Shurman | 224/211 |
| 4,082,208 | 4/1978 | Lane, Jr. | 224/209 |

FOREIGN PATENT DOCUMENTS

| | | | |
|---|---|---|---|
| 2543456 | 3/1977 | Fed. Rep. of Germany . | |
| 2844796 | 4/1980 | Fed. Rep. of Germany | 190/44 |
| 1005008 | 4/1952 | France | 224/210 |
| 182847 | 5/1936 | Switzerland | 224/209 |
| 177380 | 11/1921 | United Kingdom . | |

*Primary Examiner*—William Price
*Assistant Examiner*—Sue A. Weaver
*Attorney, Agent, or Firm*—Kurt Kelman

[57] ABSTRACT

A rucksack assembly including a plurality of hollow container sections to be stacked vertically, with each section provided with support flaps along the upper and lower opening edges thereof circumferentially being furnished with respectively a part of a divisible connecting element and with covering and bottom faces of corresponding sizes being disposed on the top and bottom of each section and the same along the free edges thereof being provided with corresponding opposite connecting elements.

3 Claims, 5 Drawing Figures

RUCKSACK ASSEMBLY

BRIEF SUMMARY OF THE INVENTION

This invention relates to a rucksack assembly comprised of a plurality of superposed box-shaped sections of textile fabric which are adapted to be separably interconnected.

Rucksack assemblies of this type are known. The sections may be of identical size or of different sizes and may be secured to a carrier frame. Each section in these known rucksack assemblies forms a closed unit, i.e. it has a top and bottom cover to provide a closed stow space. This has the disadvantage that each section has a given volume and the size of articles stowed in such a rucksack assembly is limited to the size of each closed unit.

It is the primary object of the invention to improve such a rucksack assembly so that it is not only possible to separate individual stacked sections from the assembly but also to change the interior space of the assembly at will.

This object is accomplished by the invention in a rucksack assembly of the indicated type with sections consisting of four side walls each having an upper edge and a lower edge, a top cover hingedly attached to one of the upper edges of one of the side walls and a bottom cover hingedly attached to one of the lower edges of one of the side walls. The covers have three free edges for connection to, and separation from, corresponding ones of upper and lower free edges of the side walls. Two-piece fastening elements are arranged between the corresponding free edges of the covers and the side walls, the fastening element pieces being connectable to, and separable from, each other, one of the corresponding free edges carrying one piece of a respective one of the fastening elements and the other one of the corresponding free edges carrying the other piece of the respective fastening element. In this manner, the free edges of the side walls may be selectively connected to the free edges of the covers or the free edges of the side walls of an adjacent one of the superposed sections.

With such a structure wherein each section has a top and bottom cover, each individual section may be used by itself while, when stacked and the intervening covers are detached and folded inwardly, a continuous stow space is created in the interior of the rucksack assembly between the top cover of the uppermost section and the bottom cover of the lowermost section while the intermediate covers simply hang down along the corresponding side walls inside of the rucksack assembly.

Two-piece fastening elements connectable to, and separable from, each other are well known. Preferably, they are slide fasteners but they may also be buttons affixed to one free edge and button holes in the corresponding free edge.

BRIEF DESCRIPTION OF THE DRAWING

The above and other objects and features of the present invention will become more apparent from the following detailed description of now preferred embodiments thereof, taken in conjunction with the schematic drawing wherein.

DETAILED DESCRIPTION

Figure 1:
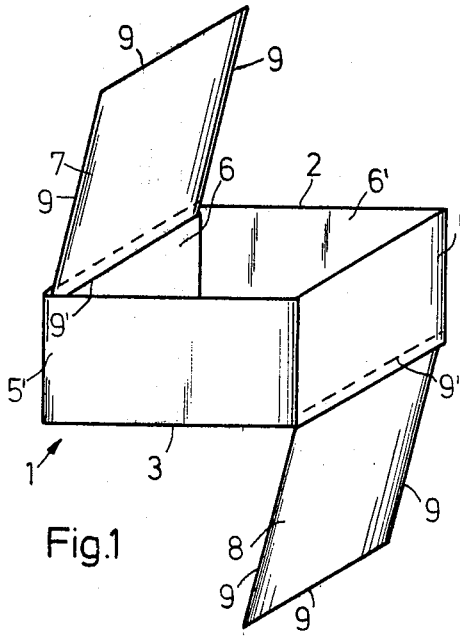
FIG. 1 is a perspective view showing one of the like sections of the rucksack assembly, the fastening elements being omitted from this figure.

Referring now to FIG. 1, there is shown rucksack assembly section 1 consisting of four side walls 5, 5', 6, 6' each having upper edge 2 and lower edge 3. Top cover 7 is hingedly attached to one upper edge 2 of said wall 6 and bottom cover 8 is hingedly attached to one lower edge 3 of side wall 5. In the illustrated embodiment, the one upper edge 2 to which top cover 7 is hingedly attached is opposite to the one lower edge 3 to which bottom cover 8 is hingedly attached. In this embodiment, the covers are permanently hingedly attached to the one upper edge and the one lower edge, respectively, by stitching 9'.

Figure 3:
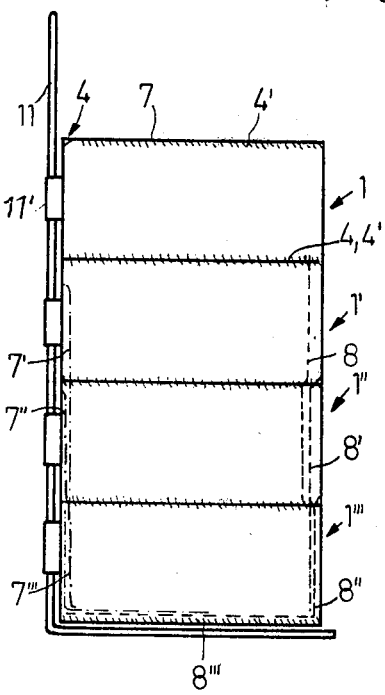
FIG. 3 is a side elevational view of a rucksack assembly of four such sections supported on a carrier frame and showing one embodiment of fastening elements connecting the sections.

Covers 7 and 8 have three free edges 9 for connection to, and separation from, corresponding free edges of the side walls. As shown in FIG. 3, two-piece fastening elements illustrated as strands 4 and 4' of slide fasteners are arranged between the corresponding free edges of the covers and the side walls. The fastening element pieces are connectable to, and separable from, each other. One of the corresponding free edges 2 carries one piece of a respective fastening element and the other corresponding free edge 3 carries the other fastening element piece. In this manner, the free edges of the side walls may be selectively connected to the free edges of the covers or the free edges of the side walls of adjacent superposed sections 1, 1', 1'' and 1'''.

Figure 2:
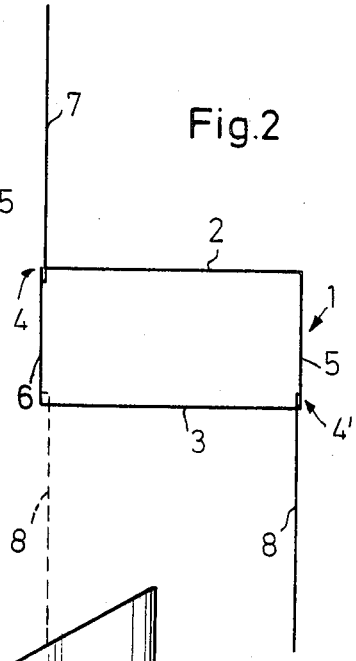
FIG. 2 is a side elevational view of the section of FIG. 1.

In this manner and as shown in FIGS. 1 and 2, each section can be used individually simply by pivoting bottom cover 8 inwardly and connecting its free edges to the free edges 3 of the side walls, filling the stow space therein, and then pivoting top cover 7 inwardly and connecting its free edges to the free edges 2 of the side wall. In this manner, a closed unit is formed.

On the other hand, sections 1, 1', 1'' and 1''' may be combined into a rucksack assembly in the manner shown in FIG. 3, with fourfold the stow space. For this purpose, lowermost bottom cover 8''' is closed in the above-described manner. Intermediate covers 7', 7'' and 7''', as well as 8, 8' and 8''' are unzipped and permitted to hang down along the side walls in the interior of the rucksack assembly. The zippers between the free edges of the adjacent sections are closed to connect the sections and, after the rucksack assembly has been filled, top cover 7 is also closed.

The whole assembly is secured in a known manner to carrier frame 11, clips 11' being provided to attach the assembly sections to the carrier frame.

Figure 4:
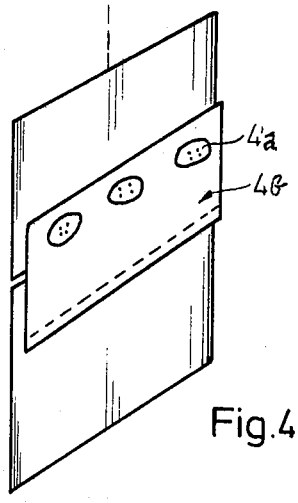
FIG. 4 is a fragmentary perspective view showing another embodiment of the fastening elements.

While slide fasteners are preferred, FIG. 4 illustrates another embodiment wherein a fabric strip 4*b* is sewn to one free edge of a respective side wall and/or cover and buttons 4*a* are sewn to the corresponding free edge, button holes being defined in the fabric strip to receive the buttons.

Figure 5:
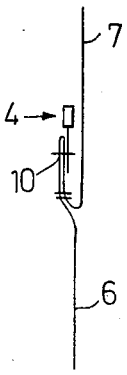
FIG. 5 is a fragmentary side elevational view of a special blank for making the sections.

As shown in FIG. 5, top cover 7 and side wall 6 hingedly attached thereto are integral with each other, attachment edge 10 being formed between the cover and side walls attached thereto for affixing piece 4 of a respective fastening element thereto. Obviously, the same type of blank may be used for bottom cover 8 and side wall 5.

As shown in broken lines in FIG. 2, bottom wall 8 may be attached to the same side wall as top cover 7 rather than the opposite wall, i.e. it makes no difference to what side wall the covers are attached.

What is claimed is:

1. A rucksack assembly comprised of a plurality of superposed box-shaped sections of textile fabric consisting of four side walls each having an upper edge and a lower edge, a top cover hingedly attached to one of the upper edges of one of the side walls and a bottom cover hingedly attached to one of the lower edges of one of the side walls, the covers having three free edges for connection to, and separation from, corresponding ones of upper and lower free edges of the side walls; and two-piece fastening elements between the corresponding free edges of the covers and the side walls, the fastening element pieces being connectable to, and separable from, each other, one of the corresponding free edges carrying one piece of a respective one of the fastening elements and the other one of the corresponding free edges carrying the other piece of the respective fastening element whereby the free edges of the side walls may be selectively connected to the free edges of the covers or the free edges of the side walls of an adjacent one of the superposed sections.

2. The rucksack assembly of claim 1, wherein the covers are permanently hingedly attached to the one upper edge and the one lower edge, respectively.

3. The rucksack assembly of claim 1, wherein the top cover and the bottom cover are integral with the one side wall whereto the covers are respectively hingedly attached, an attachment edge being formed between each cover and the one side wall attached thereto for affixing one piece of a respective one of the two-piece fastening elements.

* * * * *